US010960321B1

(12) United States Patent
Kranzo et al.

(10) Patent No.: US 10,960,321 B1
(45) Date of Patent: Mar. 30, 2021

(54) MAGIC TRICK APPARATUS AND METHODS THEREOF

(71) Applicant: Penguin Magic, Inc., North Las Vegas, NV (US)

(72) Inventors: Nathan Kranzo, North Las Vegas, NV (US); Acar Altinsel, North Las Vegas, NV (US)

( * ) Notice: Subject to any disclaimer, the term of this patent is extended or adjusted under 35 U.S.C. 154(b) by 0 days.

(21) Appl. No.: 16/750,657

(22) Filed: Jan. 23, 2020

(51) Int. Cl.
*A63J 21/00* (2006.01)
*A63H 33/00* (2006.01)

(52) U.S. Cl.
CPC ..... *A63J 21/00* (2013.01)

(58) Field of Classification Search
CPC ..... A63J 21/00; A63H 33/00; A63H 33/046; A63H 33/06
USPC ..... 472/71–75; 446/92
See application file for complete search history.

(56) References Cited

U.S. PATENT DOCUMENTS 2,199,818 A * 5/1940 Franke ..... A63J 21/00 472/71
5,409,236 A * 4/1995 Therrien ..... A63F 9/1204 273/156
9,821,244 B1 * 11/2017 Whang ..... A63H 33/046

* cited by examiner

*Primary Examiner* — Kien T Nguyen
(74) *Attorney, Agent, or Firm* — Polsinelli PC

(57) ABSTRACT

A magic trick apparatus and methods of use is described. The magic trick apparatus may include a half ball having a rounded side and a flat surface and a coin attached to the flat surface of the half ball. The magic trick apparatus may further include a magnet within a recession on the flat surface of the half ball. The magic trick apparatus may be used to "transform" a coin into a ball.

17 Claims, 4 Drawing Sheets

MAGIC TRICK APPARATUS AND METHODS THEREOF

FIELD

The present disclosure relates generally to a magic trick apparatus and methods for performing a magic trick using the magic trick apparatus. In at least one example, the present disclosure relates to magic trick apparatuses and methods to perform a transformation of a coin to a ball, or vice versa.

BACKGROUND

Magicians have devised magic tricks to make audiences perceive intended illusions for amusement and wonder. To implement magic tricks in close proximity, the magicians use various articles and devices that may include everyday items, such as coins and cards. However, magicians are constantly looking for new, simple, and quick tricks that may be easily learned and portable.

As presented herein, a magic trick apparatus has been developed to help magicians easily perform a transformation of a coin to a ball, or vice versa.

BRIEF SUMMARY

Provided herein is a magic trick apparatus operable to allow a magician to perform a transformation of a coin to a ball. The magic trick apparatus may include a half ball and a coin attached to the flat surface of the half ball. In some aspects, the half ball includes a recession within the flat surface of the half ball and a magnet within the recession. In additional aspects, the recession and/or magnet may then be covered by the coin on the flat surface.

Further provided herein is a method for transforming a coin into a ball. In some aspects, the method may include providing a magic trick apparatus, showing an observer only the coin attached to the flat surface of the half ball, showing the observer only the rounded side of the half ball, and replacing the magic trick apparatus with a complete ball identical in outer appearance to the rounded side of the half ball.

Other aspects and iterations of the invention are described more thoroughly below.

BRIEF DESCRIPTION OF THE DRAWINGS

Implementations of the present technology will now be described, by way of example only, with reference to the attached figures, wherein.

DETAILED DESCRIPTION

Figure 1:
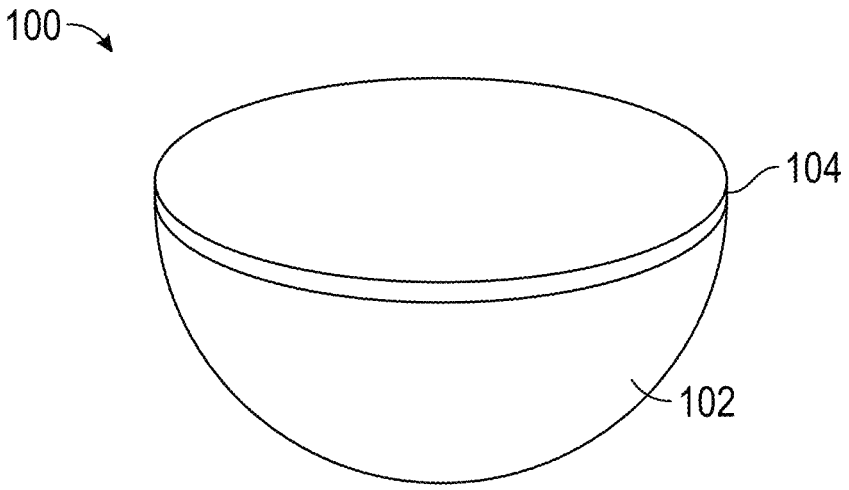
FIG. 1 shows a magic trick apparatus in one example.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The magic trick apparatus is a unique and novel apparatus to transform a coin into a ball. The magic trick apparatus is a half ball, i.e. hemisphere, with a coin connected to the flat surface, such that it may present to an observer as only a coin when viewed from one side and only a ball when viewed from an opposite side. In this way, the magician may easily "transform" the coin into the ball, or vice versa. In addition, the magic trick apparatus may be paired with a complete ball that looks similar or identical to the half ball for inspection by the observer.

Figure 2:
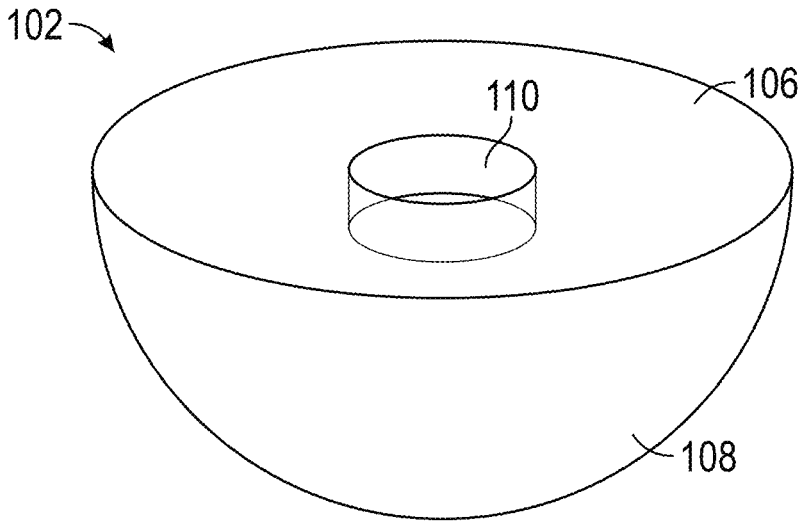
FIG. 2 shows the half ball portion of a magic trick apparatus in one example.

Referring to FIGS. 1 and 2, the magic trick apparatus 100 includes a half ball 102 and a coin 104 attached to the flat surface 106 of the half ball 102. The half ball 102 may be a hemisphere of a complete ball, such that it has a substantially rounded side 108 and a flat surface 106 opposite the rounded side. In some examples, the half ball may be formed by cutting a complete ball in half, thus creating two half balls or hemispheres. In other examples, the half ball may be molded in a hemisphere shape without first being formed as a complete ball. In at least one example, the half ball may be injection molded. The half ball may formed from or resemble any handheld ball when viewed from the rounded side, for example, a rubber "bouncy" ball, a ping pong ball, a golf ball, a tennis ball, or any other plastic or rubber ball. The half ball may be solid or hollow. In some examples, when the half ball is hollow, the flat surface may be the circumference of the half ball. The half ball may have a diameter ranging from about 5 mm to about 75 mm.

The coin 104 may be any circular shaped disk appropriately sized for matching the circumference of the flat surface 106 of the half ball 102. Non-limiting examples of the coin may include US currency, such as a quarter, half dollar, nickel, etc., a foreign currency coin, a chip, such as a poker chip, a token, or a coin with no assigned value. The coin 104 may be attached or connected to the flat surface 106 of the half ball 102 by an adhesive or any mechanism operable to connect the two materials. In some examples, the adhesive may be glue or super glue. The coin may have a diameter ranging from about 5 mm to about 75 mm.

As seen in FIG. 2, the half ball 102 may include a recession 110 within the flat surface 106 of the half ball 102. In some examples, the recession 110 may be located in the center of the flat surface 106. The recession 110 may have a diameter ranging from about 2 mm to about 25 mm. In various examples, the recession may have a diameter of about 2 mm, up to about 5 mm, up to about 10 mm, up to about 15 mm, up to about 20 mm, or up to about 25 mm. The recession 110 may have a depth of about 1/16 in to about ½ in. In various examples, the recession may have a depth of about 0.0625 in, up to 0.125 in, up to 0.25 in, or up to 0.5 in. The recession 110 may be carved out of the half ball, or the half ball may be molded with the recession formed within the flat surface.

Figure 3:
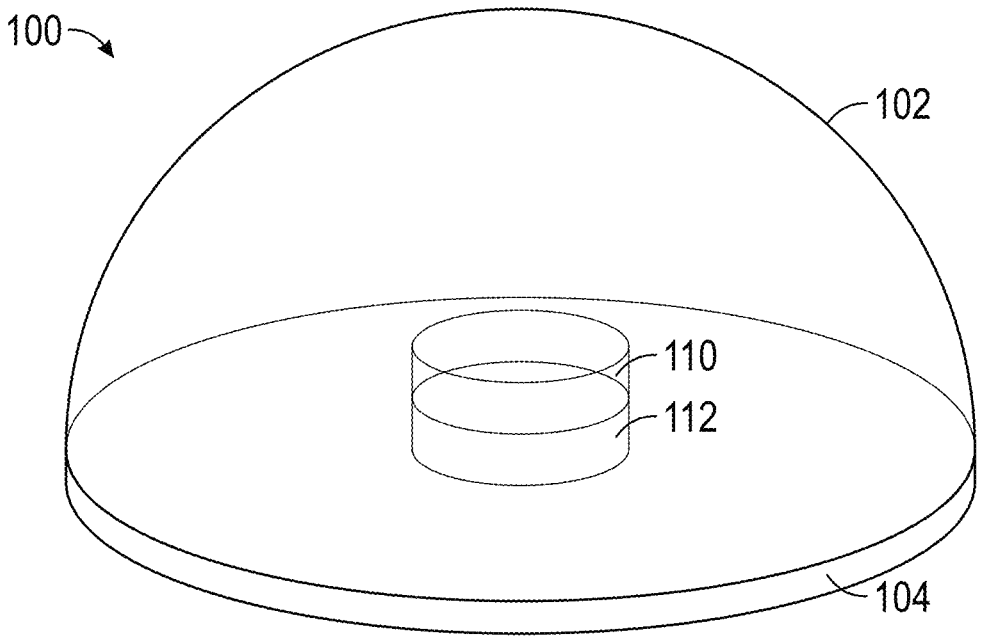
FIG. 3 shows an internal view of an example assembled magic trick apparatus.
Figure 4:
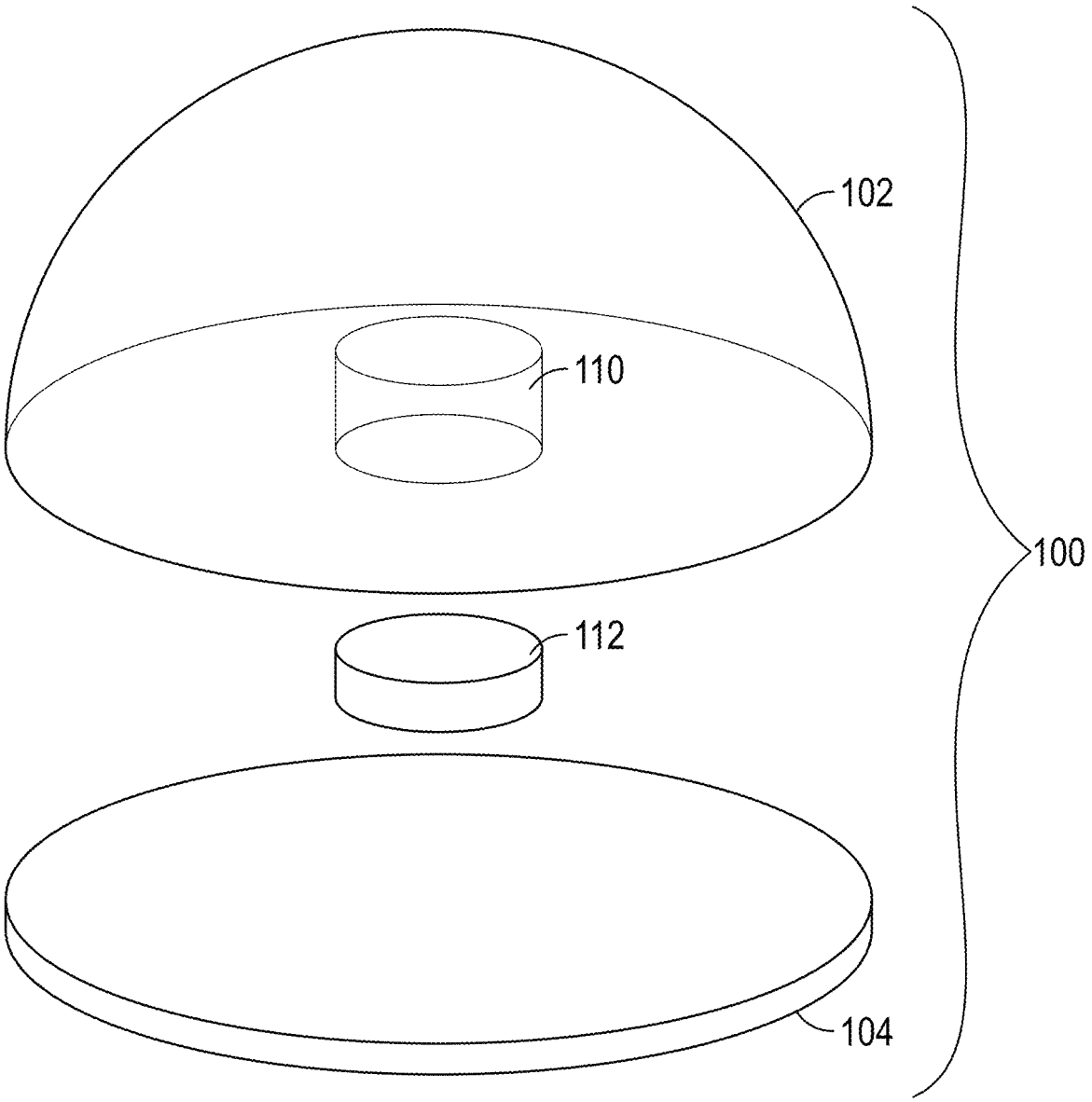
FIG. 4 shows an exploded view of an example magic trick apparatus.

In some examples, as seen in FIGS. 3-4, a magnet 112 may be placed within the recession 110. The magnet 112 may have a diameter ranging from about 2 mm to about 25 mm. In various examples, the magnet may have a diameter of about 2 mm, up to about 5 mm, up to about 10 mm, up to about 15 mm, up to about 20 mm, or up to about 25 mm. The magnet 112 may have a depth of about 1/16 in to about ½ in. In various examples, the magnet may have a depth of about 0.0625 in, up to 0.125 in, up to 0.25 in, or up to 0.5 in. FIG. 3 shows an internal view of an example assembled magic trick apparatus 100 and FIG. 4 shows an exploded view of an example magic trick apparatus 100. In at least some examples, if the half ball is hollow, the hollow cavity of the half ball may act as the recession. The recession 110 and/or magnet 112 may then be covered by the coin 104 on the flat surface 102, thus keeping the magnet hidden from the observer. The magnet may be used to quickly store the magic trick apparatus out of view of the observer. For example, a second magnet may be located in the magician's back pocket, such that the magnet in the recession of the half ball connects to the magnet in the second magnet, out of sight of the observer. In other examples, the half ball 102 does not include a recession and the flat surface 106 of the half ball 102 is flat along a single plane. In this example, the coin 104 is directly attached to the flat surface 106 of the half ball 102 without the flat surface having a recession and/or a magnet. The magic trick apparatus 100 may then be stored out of view from the observer using other sleight of hand techniques, without the need for a magnet.

Figure 5:
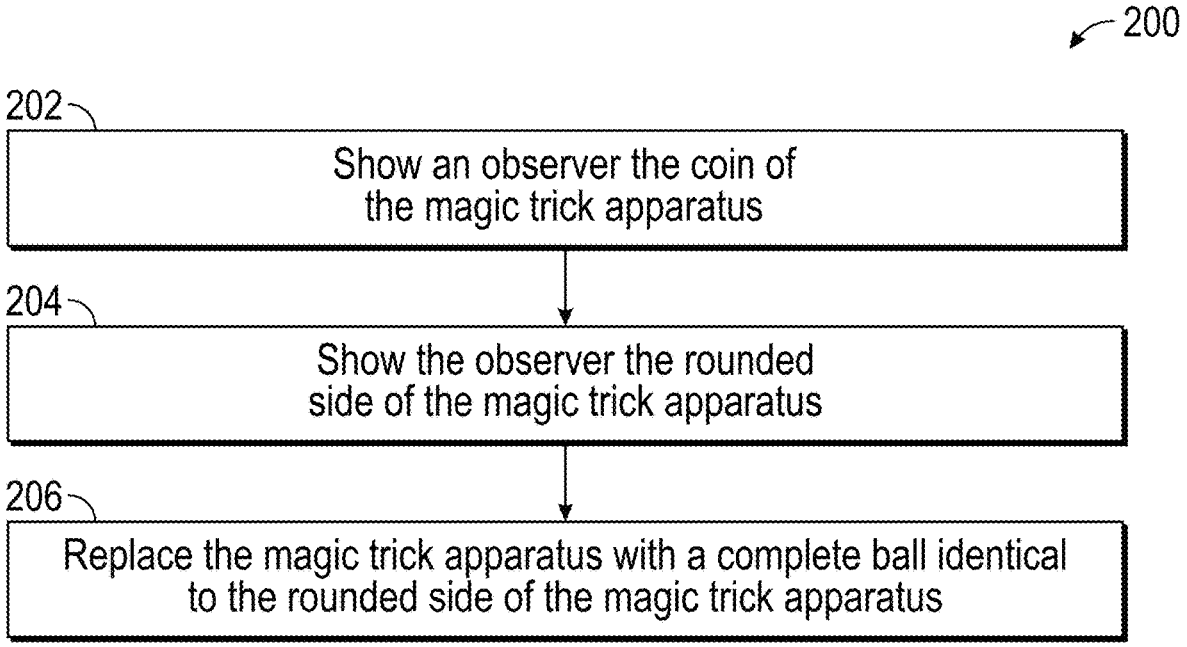
FIG. 5 a flowchart of a method of transforming a coin into a ball in one example.

Further provided herein are methods of performing a transformation of a coin to a ball, or vice versa. Referring to FIG. 5, a flowchart is presented in accordance with an example embodiment. The method 200 is provided by way of example, as there are a variety of ways to carry out the method. The method 200 described below can be carried out using the configurations illustrated in FIGS. 1, 3, and 4, for example, and various elements of these figures are referenced in explaining example method 200. Each block shown in FIG. 5 represents one or more processes, methods or subroutines, carried out in the example method 200. Furthermore, the illustrated order of blocks is illustrative only and the order of the blocks can change according to the present disclosure. Additional blocks may be added or fewer blocks may be utilized, without departing from this disclosure.

The example method 200 is a method of transforming a coin into a ball using the magic trick apparatus. The example method 200 can begin at block 202. At block 202, a coin is shown to an observer. The coin shown to the observer should match the coin on the magic trick apparatus. For example, if the magician shows a US quarter to an observer, a US quarter should also be attached to the flat surface of the half ball of the magic trick apparatus. Alternatively, the coin shown to the observer is the coin attached to the magic trick apparatus, such that the half ball side of the magic trick apparatus is out of view of the observer.

At block 204, the rounded side of the half ball is shown to the observer. In this step, the coin may be "transformed" into a ball through sleight of hand with the magic trick apparatus, such that the half ball side of the magic trick apparatus is viewable by the observer and the coin side is out of view of the observer.

At block 206, the magic trick apparatus may be replaced with a complete ball similar or identical in outer appearance to the half ball side of the magic trick apparatus. The magic trick apparatus may attach to an out of sight location on the magician, such as a back pocket, using the magnet within the recession of the half ball covered by the coin. This may allow for a quick and seamless transition to the complete ball. In some examples, the complete ball may be bounced and/or handed to the observer for inspection.

In some examples, the steps of method 200 may be performed in reverse, such that the ball is "transformed" into a coin. In this example, the magic trick apparatus may be The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A magic trick apparatus, comprising:

a rubber half ball comprising a rounded side and a flat surface having a circumference; and a coin attached to the flat surface of the half ball by an adhesive, wherein the coin matches the circumference of the flat surface of the half ball such that the magic trick apparatus presents to an observer as only a coin when viewed from one side and only a ball when viewed from an opposite side.

2. The magic trick apparatus of claim 1, wherein the flat surface comprises a recession.

3. The magic trick apparatus of claim 2 further comprising a magnet within the recession, wherein the coin covers the recession and magnet when attached to the flat surface of the half ball.

4. The magic trick apparatus of claim 1, wherein the flat surface of the half ball is flat along a single plane without a recession.

5. The magic trick apparatus of claim 1, wherein the half ball is formed by cutting a complete ball in half.

6. The magic trick apparatus of claim 1, wherein the half ball is molded in a hemisphere shape.

7. The magic trick apparatus of claim 1, wherein the coin is a US quarter, a US half dollar, a US nickel, a foreign currency coin, a chip, a token, or a coin with no assigned value.

8. A method of transforming a coin into a ball, comprising:

providing a magic trick apparatus comprising:

a rubber half ball comprising a rounded side and a flat surface having a circumference; and a coin attached to the flat surface of the half ball by an adhesive, wherein the coin matches the circumference of the flat surface of the half ball such that the magic trick apparatus presents to an observer as only a coin when viewed from one side and only a ball when viewed from an opposite side;

showing the observer only the coin attached to the flat surface of the half ball;

showing the observer only the rounded side of the half ball; and replacing the magic trick apparatus with a complete ball identical in outer appearance to the rounded side of the half ball.

9. The method of claim 8 further comprising providing the complete ball to the observer.

10. The method of claim 8, wherein the magic trick apparatus further comprises a magnet within a recession on the flat surface of the half ball.

11. The method of claim 10, wherein the magic trick apparatus is replaced with the complete ball by attaching the magnet of the magic trick apparatus to a second magnet.

12. The method of claim 8, wherein the flat surface of the half ball is flat along a single plane without a recession.

13. A magic trick apparatus, comprising:

a half ball comprising a rounded side and a flat surface having a circumference; and a coin attached to the flat surface of the half ball by an adhesive, wherein the coin matches the circumference of the flat surface of the half ball such that the magic trick apparatus presents to an observer as only a coin when viewed from one side and only a ball when viewed from an opposite side.

14. The magic trick apparatus of claim 13, wherein the flat surface comprises a recession.

15. The magic trick apparatus of claim 14 further comprising a magnet within the recession, wherein the coin covers the recession and magnet when attached to the flat surface of the half ball.

16. The magic trick apparatus of claim 13, wherein the half ball is formed from or the rounded side of the half ball appears to be a rubber ball, a ping pong ball, a golf ball, a tennis ball, or a plastic ball.

17. The magic trick apparatus of claim 13, wherein the coin is a US quarter, a US half dollar, a US nickel, a foreign currency coin, a chip, a token, or a coin with no assigned value.

* * * * *